US005152353A

United States Patent [19]

Denton et al.

[11] Patent Number: 5,152,353

[45] Date of Patent: Oct. 6, 1992

[54] HIGH SPEED ROCK BIT

[75] Inventors: Robert Denton, Friendswood, Tex.; Ernst Gugger, Bologna, Italy

[73] Assignee: Smith International, Inc., Houston, Tex.

[21] Appl. No.: 632,084

[22] Filed: Dec. 21, 1990

[51] Int. Cl.[5] ..... E21B 10/22

[52] U.S. Cl. ..... 175/228; 175/372; 175/374

[58] Field of Search ..... 175/228, 229, 371, 372, 175/374

[56] References Cited

U.S. PATENT DOCUMENTS

| | | | |
|---|---|---|---|
| 3,132,123 | 5/1964 | Harris, Jr. et al. | 260/87.5 |
| 3,291,843 | 12/1966 | Fritz et al. | 260/614 |
| 3,467,638 | 9/1969 | Pattison | 260/87.5 |
| 3,546,186 | 12/1970 | Gladding et al. | 260/80.73 |
| 3,682,872 | 8/1972 | Brizzolara et al. | 260/80.76 |
| 4,254,837 | 3/1981 | Jones | 175/67 |
| 4,281,092 | 7/1981 | Breazeale | 526/247 |
| 4,414,159 | 11/1983 | Resnick | 560/449 |
| 4,513,128 | 4/1985 | Uschold | 526/212 |
| 4,529,784 | 7/1985 | Finley | 526/247 |
| 4,588,309 | 5/1986 | Uyehara et al. | 175/227 X |
| 4,840,994 | 6/1989 | Moggi et al. | 525/72 |

OTHER PUBLICATIONS

G. H. Kalb, et al., Terpolymers of Tetrafluoroethylene Perfluoro (Methyl Vinyl Ether), and Certain Cure Site Monomers, Apr. 13, 1972, pp. 13–26, Research Laboratory, Elastomer Chemicals Department, E. I. Du Pont de Nemours and Co., Inc.

Downhole Conditions Change . . . Kalrez Seals Don't, Jun. 1988, 8 pages—DuPont Company Fabricated Products Dept. Kalrez Parts Marketing Section.

What Does It Cost to "Pull" A Well Because of Seal Failure? -It's Hard to Put a Price on Dependability, But it's easy to put a name on it-Kalrez Perfluoroelastomer Parts, 6 pages, DuPont Kalrez Bartley Mill Plaza #18.

DuPont Kalrez Engineering Report-Comparative Performance of Elastomeric Seals for Use in the Oil Production Industry. 4 pages, DuPont Company.

DuPont Kalrez Seals-A lot Less Expensive Than the Cost of Downhole Seal Failure, 4 pages, DuPont Company.

*Primary Examiner*—Terry Lee Melius

*Attorney, Agent, or Firm*—Christie, Parker & Hale

[57] ABSTRACT

A rock bit for drilling subterranean formations has improved dynamic O-ring seals for retaining lubricant around the rock bit bearings during operation at more than 50 meters per minute surface speed on the O-rings. Such a bit has a plurality of journal pins, each having a bearing surface, and a cutter cone mounted on each journal pin and including a bearing surface. A pressure-compensated grease reservoir is in communication with such bearing surfaces for maintaining a grease adjacent to the bearing surfaces. The grease is sealed in with dynamic O-ring seals comprising a perfluorinated terpolymer of tetrafluoroethylene, perfluoro(methyl vinyl ether) and a cure site monomer for introducing cross-linking sites. Preferably the cure site monomer is selected from the group consisting of trifluoroethylene, vinyl perfluoroalkyls and monomers including a perfluoroalkyl ether group.

7 Claims, 1 Drawing Sheet

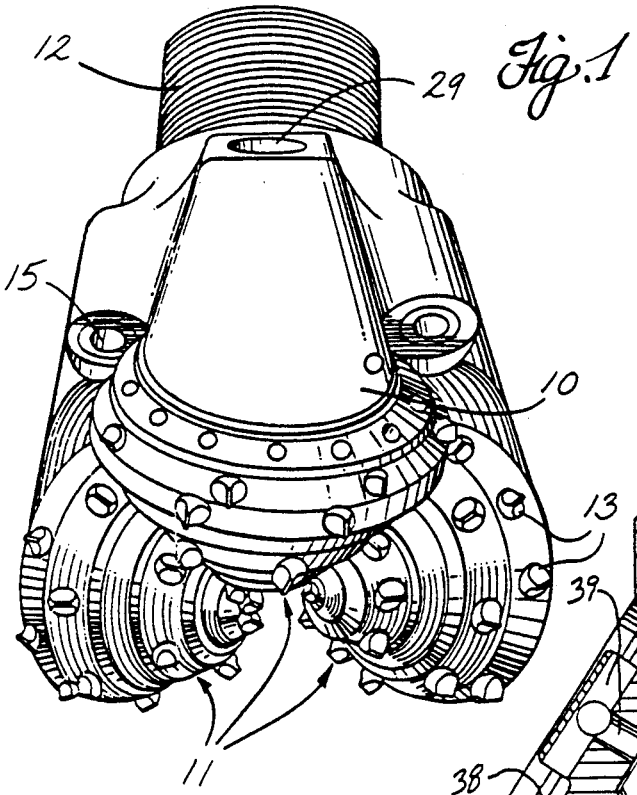
Fig. 1
Fig. 2
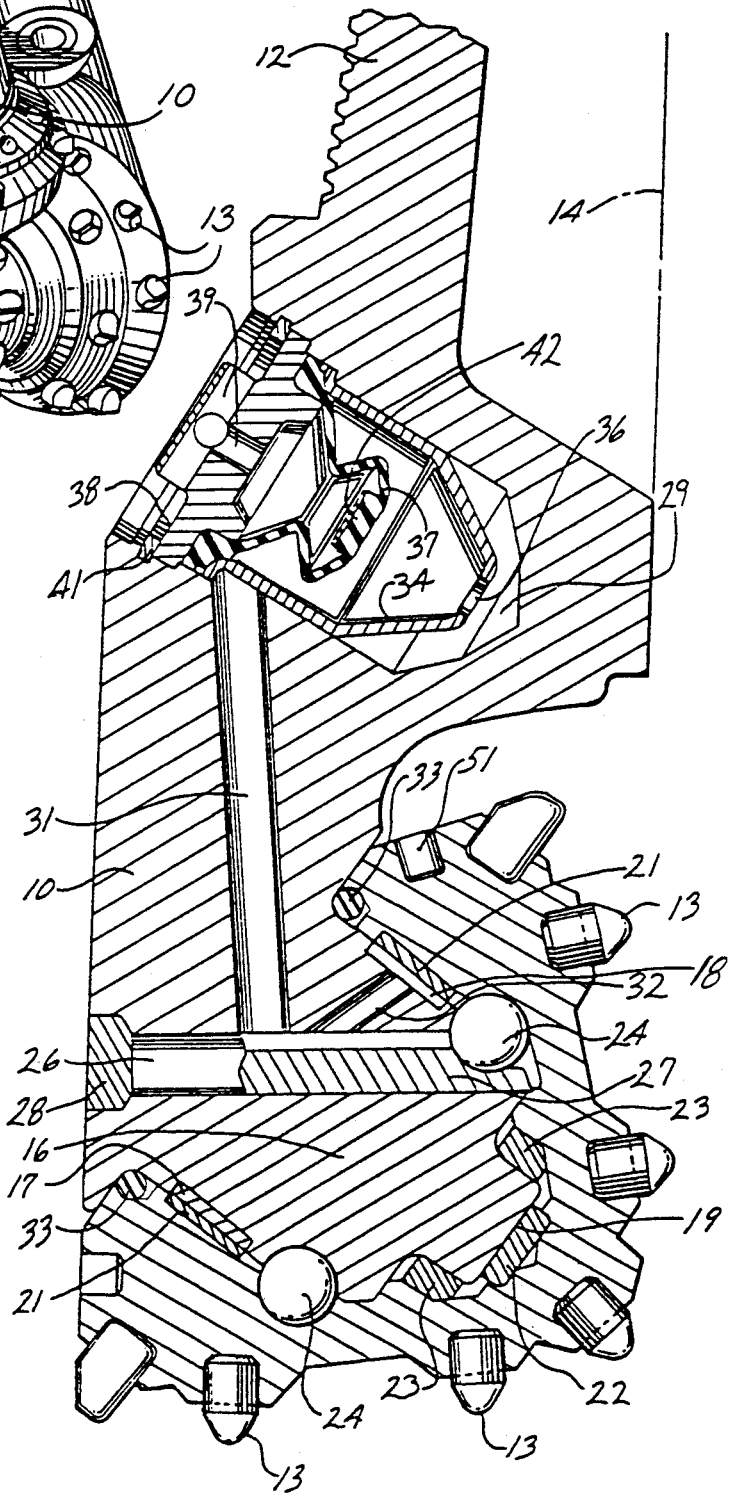

HIGH SPEED ROCK BIT

FIELD OF THE INVENTION

This invention relates to a dynamic O-ring seal for retaining the lubricant around the journal bearings in a high speed rock bit for drilling oil wells or the like.

BACKGROUND OF THE INVENTION

Heavy-duty rock bits are employed for drilling wells in subterranean formations for oil, gas, geothermal steam, and the like. Such bits have a body connected to a drill string and a plurality, typically three, of hollow cutter cones mounted on the body for drilling rock formations. The cutter cones are mounted on steel journals or pins integral with the bit body at its lower end. In use, the drill string and bit body are rotated in the bore hole, and each cone is caused to rotate on its respective journal as the cone contacts the bottom of the bore hole being drilled.

While such a rock bit is used in hard, tough formations, high pressures and temperatures are encountered. The total useful life of a rock bit in such severe environments is in the order of 20 to 200 hours for bits in sizes of about 6½ to 12¼ inch diameter at depths of about 5000 to 20,000 feet. Useful lifetimes of about 65 to 150 hours are typical.

When a rock bit wears out or fails as a bore hole is being drilled, it is necessary to withdraw the drill string for replacing the bit. The time required to make a round trip for replacing a bit is essentially lost from drilling operations. This time can become a significant portion of the total time for completing a well, particularly as the well depths become great. It is therefore quite desirable to maximize the lifetime of a drill bit in a rock formation. Prolonging the time of drilling minimizes the lost time in "round tripping" the drill string for replacing bits.

Replacement of a drill bit can be required for a number of reasons, including wearing out or breakage of the structure contacting the rock formation. One reason for replacing the rock bits includes failure or severe wear of the journal bearings on which the cutter cones are mounted. These bearings are subject to very high pressure drilling loads, high hydrostatic pressures in the hole being drilled, and high temperatures due to drilling, as well as elevated temperatures in the formation being drilled. Considerable development work has been conducted over the years to produce bearing structures and to employ materials that minimize wear and failure of such bearings.

The journal bearings are lubricated with grease adapted to such severe conditions. Such lubricants are a critical element in the life of a rock bit and considerable work has been done to improve such greases. Lubrication failure can sometimes be attributed to misfit of bearings or O-ring seal failure, as well as problems with a grease.

Pressure and temperature conditions in a rock bit can vary with time as the rock bit is used. For example, when a "joint" of pipe is added to the drill string, weight on the bit can be relieved and slight flexing can occur. Such variations can result in "pumping" of the grease through O-ring seals, leading to loss of grease or introduction of foreign materials, such as drilling mud, that can damage bearing surfaces. It is desirable to provide a seal with sufficient resilience to resist such changing conditions, and to retain that resilience over a long period of time under adverse conditions.

One of the consistent problems in rock bits is the inconsistency of lifetime. Sometimes bits last for long periods, whereas bits which are apparently identical operated under similar conditions may fail with a short lifetime. One cause of erratic lifetime is failure of the bearings. Bearing failure can often be traced to failure of the dynamic seal that retains lubricant in the bearing. Lubricant may be lost if the seal fails, or abrasive particles of rock may work their way into the bearing surfaces, causing excessive wear.

Rock bit O-rings are being called on to perform service in environments which are extremely harsh. Some modern bits are being run at high rotational speeds, for example, 250 RPM for a 7⅞ inch diameter bit, with some 17½ inch diameter bits being operated at speeds up to 325 RPM. Such high rotational speeds impose high surface speeds on the dynamic O-ring seals, sometimes more than 100 meters per minute and often more than 50 meters per minute. This exacerbates the problems of elevated temperature due to frictional heating and slow dissipation of that heat. The life of the O-ring may be significantly degraded by the resultant high temperatures due to friction (as well as elevated temperature in the well bore) and abrasion.

It is therefore desirable to provide a consistently reliable dynamic O-ring seal for maintaining the lubricant within rock bits over a long useful life at high operating speeds. The O-ring should be resistant to crude gasoline and other chemical compositions found within oil wells, have high heat resistance and should not readily deform under changing load to allow leakage of the grease from within the bit or intrusion of abrasive drilling mud into the bearing.

SUMMARY OF THE INVENTION

There is, therefore, provided in practice of this invention according to a presently preferred embodiment, a rock bit for drilling subterranean formations, with improved dynamic O-ring seals for retaining lubricant around the rock bit bearings, comprising a plurality of journal pins, each having a bearing surface, and a cutter cone mounted on each journal pin and including a bearing surface. A pressure-compensated grease reservoir is in communication with such bearing surfaces for maintaining a grease adjacent to the bearing surfaces. The grease is sealed in with dynamic O-ring seals comprising a perfluorinated terpolymer of tetrafluoroethylene, perfluoro(methyl vinyl ether) and a cure site monomer for introducing crosslinking sites. Preferably the cure site monomer is selected from the group consisting of trifluoroethylene, vinyl perfluoroalkyls and monomers including a perfluoroalkyl ether group.

BRIEF DESCRIPTION OF THE DRAWINGS

FIG. 1 is a semi-schematic rock bit containing an O-ring seal; and,

FIG. 2 is a partial cross section of a rock bit containing an O-ring seal.

DETAILED DESCRIPTION

A rock bit employing an 0-ring seal comprises a body 10 having three cutter cones 11 mounted on its lower end. A threaded pin 12 is at the upper end of the body for assembly of the rock bit onto a drill string for drilling oil wells or the like. A plurality of tungsten carbide inserts 13 are pressed into holes in the surfaces of the cutter cones for bearing on the rock formation being drilled. Nozzles 15 in the bit body introduce drilling mud into the space around the cutter cones for cooling and carrying away formation chips drilled by the bit.

FIG. 2 is a fragmentary, longitudinal cross-section of the rock bit, extending radially from the rotational axis 14 of the rock bit through one of the three legs on which the cutter cones 11 are mounted. Each leg includes a journal pin 16 extending downwardly and radially inwardly on the rock bit body. The journal pin includes a cylindrical bearing surface having a hard metal insert 17 on a lower portion of the journal pin. The hard metal insert is typically a cobalt or iron-base alloy welded in place in a groove on the journal leg and having a substantially greater hardness than the steel forming the journal pin and rock bit body. An open groove 18 is provided on the upper portion of the journal pin. Such a groove may, for example, extend around 60% or so of the circumference of the journal pin, and the hard metal 17 can extend around the remaining 40% or so. The journal pin also has a cylindrical nose 19 at its lower end.

Each cutter cone 11 is in the form of a hollow, generally-conical steel body having tungsten carbide inserts 13 pressed into holes on the external surface. For long life, the inserts may be tipped with a polycrystalline diamond layer. Such tungsten carbide inserts provide the drilling action by engaging a subterranean rock formation as the rock bit is rotated. Some types of bits have hard-faced steel teeth milled on the outside of the cone instead of carbide inserts.

The cavity in the cone contains a cylindrical bearing surface including an aluminum bronze insert 21 deposited in a groove in the steel of the cone or as a floating insert in a groove in the cone. The aluminum bronze insert 21 in the cone engages the hard metal insert 17 on the leg and provides the main bearing surface for the cone on the bit body. A nose button 22 is between the end of the cavity in the cone and the nose 19 and carries the principal thrust loads of the cone on the journal pin. A bushing 23 surrounds the nose and provides additional bearing surface between the cone and journal pin.

Other types of bits, particularly for higher rotational speed applications, have roller bearings instead of the exemplary journal bearings illustrated herein.

A plurality of bearing balls 24 are fitted into complementary ball races in the cone and on the journal pin. These balls are inserted through a ball passage 26, which extends through the journal pin between the bearing races and the exterior of the rock bit. A cone is first fitted on the journal pin, and then the bearing balls 24 are inserted through the ball passage. The balls carry any thrust loads tending to remove the cone from the journal pin and thereby retain the cone on the journal pin. The balls are retained in the races by a ball retainer 27 inserted through the ball passage 26 after the balls are in place. A plug 28 is then welded into the end of the ball passage to keep the ball retainer in place.

The bearing surfaces between the journal pin and cone are lubricated by a grease composition. Preferably, the interior of the rock bit is evacuated, and grease is introduced through a fill passage (not shown). The grease thus fills the regions adjacent the bearing surfaces plus various passages and a grease reservoir, and air is essentially excluded from the interior of the rock bit. The grease reservoir comprises a cavity 29 in the rock bit body, which is connected to the ball passage 26 by a lubricant passage 31. Grease also fills the portion of the ball passage adjacent the ball retainer, the open groove 18 on the upper side of the journal pin, and a diagonally extending passage 32 therebetween. Grease is retained in the bearing structure by a resilient seal in the form of an O-ring 33 between the cone and journal pin. Preferably, the O-ring is in a slightly V-shaped groove.

A pressure compensation subassembly is included in the grease reservoir 29. This subassembly comprises a metal cup 34 with an opening 36 at its inner end. A flexible rubber bellows 37 extends into the cup from its outer end. The bellows is held in place by a cap 38 with a vent passage 39. The pressure compensation subassembly is held in the grease reservoir by a snap ring 41.

When the rock bit is filled with grease, the bearings, the groove 18 on the journal pin, passages in the journal pin, the lubrication passage 31, and the grease reservoir on the outside of the bellows 37 are filled with grease. If the volume of grease expands due to heating, for example, the bellows 37 is compressed to provide additional volume in the sealed grease system, thereby preventing accumulation of excessive pressures. High pressure in the grease system can damage the O-ring seal 33 and permit drilling mud or the like to enter the bearings. Such material is abrasive and can quickly damage the bearings. Conversely, if the grease volume should contract, the bellows can expand to prevent low pressures in the sealed grease systems, which could cause flow of abrasive and/or corrosive substances past the O-ring seal.

The bellows has a boss 42 at its inner end which can seat against the cap 38 at one end of the displacement of the bellows for sealing the vent passage 39. The end of the bellows can also seat against the cup 34 at the other end of its stroke, thereby sealing the opening 36. If desired, a pressure-relief check valve can also be provided in the grease reservoir for relieving overpressures in the grease system that could damage the O-ring seal.

To maintain the desired properties of the O-ring seal at the pressure and temperature conditions that prevail in a rock bit, to inhibit "pumping" of the grease through the O-ring seal, and for a long useful life during high speed operation, it is important that the O-ring seal be resistant to crude gasoline and other chemical compositions found within oil wells, have high heat and abrasion resistance, have low rubbing friction, and will not readily deform and allow leakage of the grease from within the bit or drilling mud into the bit.

A variety of O-ring seals have been employed in such rock bits. Such O-rings typically comprise acrylonitrile polymers or acrylonitrile/butadiene copolymers. However, these synthetic rubbers exhibit poor heat resistance and become brittle at elevated temperatures after extended periods of time. Additionally, such compounds often exhibit undesirably high coefficients of friction which induces frictional heating when a bit is operated at high speed. Such properties are undesirable for a seal in a rock bit, since the high operating temperatures of the bit result in frequent failure of the seal. The problem is particularly severe when the bits are run at high operating speeds.

The dynamic O-ring seal used in the present invention comprises a perfluoroelastomer which has outstanding resistance to chemical attack, excellent thermal stability at elevated temperature, and an extremely low coefficient of friction. The elastomer is a terpolymer of tetrafluoroethylene (TFE) and perfluoro(methyl vinyl) ether (PMVE) (sometimes referred to as perfluoromethyl perfluorovinylether) and a small amount of cure site monomer for introducing crosslinking sites.

The important feature of the O-ring composition is the crosslinked elastomeric terpolymer of TFE, PMVE and a cure site monomer. For a polymer to exhibit good elastomeric properties, it is necessary that the individual polymer molecules be interconnected in such a way as to form a three-dimensional network. Usually, the interconnections or crosslinks are formed by chemical reaction involving two or more polymer molecules. However, because of their chemical inertness, polymers of TFE and PMVE are not readily crosslinked by ordinary means, and a third cure site monomer is necessary to serve as the cross-linking site.

The requirements for the third cure site monomer and crosslinking reaction are stringent, but, for purposes of this invention, it is sufficient that the resulting terpolymer is nearly comparable to the dipolymer in thermal, oxidation and chemical resistance to preserve the properties of the dipolymer. Preferably the cure site monomer is selected from the group consisting of trifluoroethylene, vinyl perfluoroalkyls and monomers including a perfluoroalkyl ether group.

The perfluoroelastomer comprises from one to four mols of TFE per mol of PMVE. In other words, the composition ranges from about 50:50 to 20:80 PMVE:TFE. The proportion of cure site monomer is typically no more than two mol percent.

The terpolymer is cured with a small amount of conventional curing agent, typically less than 5 phr (parts per hundred parts rubber). Suitable curing agents include Diak #1 (hexamethylene diamine carbamate), Diak #3 (N,N,-dicinnnamylidine-1,6-hexanediamine), Diak #4 (an L alicyclic amine salt), Viton 20 and Viton 30 which are proprietary curing agents available from E. I. DuPont de Nemours & Co., Wilmington, Del. Other curing agents which will introduce cross linking may include dicumyl peroxide, TBPB, bisphenol and the like.

A metal oxide accelerator (PbO, MgO, CaO) may also be included in conventional proportions (for example, in the range of from 2 to 5 phr). Such basic materials are desirable to minimize blistering or sponginess. Litharge is a preferred accelerator. Slow curing is desirable since water is a product of vulcanization and long times at elevated temperature are required to prevent sponginess because of the low permeability of the elastomer. Thus, a relatively small amount of accelerator may be used. A typical cure includes up to 2½ days at 260° C. (500° F.).

The composition of the O-ring also includes abrasion and heat resistant carbon black (MT, SAF or HAF) in the range of from 5 to 30 phr for strength.

Small amounts of conventional plasticizer and processing aids may also be included but are ordinarily not used.

Suitable O-rings are manufactured from Kalrez (trademark) perfluoroelastomer resins available from E. I. DuPont de Nemours & Co., Wilmington, Del. Kalrez seals, including O-rings, have been available for 18 to 20 years. Such seals and O-rings have been used in static applications in subterranean oil wells and the like, because of their outstanding chemical and thermal resistance. It has now been discovered that such O-rings are particularly well suited for a high speed dynamic seal between the cone and journal of a rock bit. It is presently believed that the best O-ring is made from a perfluoroelastomer designated as Kalrez 3018 by DuPont.

It is important to use such O-rings for retaining the grease in a rock bit operated at rotational speeds where the O-ring is subjected to surface speeds more than 50 meters per minute. Nitrile O-rings have been found to be suitable for lower speeds of dynamic seal in a rock bit, but are subject to significant limitations when operated at surface speeds more than 50 meters per minute in the harsh environment of a rock bit. It is found that these O-rings have very low frictional characteristics in the dynamic seal of the rock bit and, hence, operate at lower temperatures than conventional nitrile O-rings.

This can be demonstrated in a bearing and seal testing apparatus used for evaluating rock bit bearings and seals. In this apparatus, a cone is mounted on a journal with a dynamic O-ring seal similar to the seal in a rock bit. The cone is mounted eccentrically on the journal to simulate the dynamic conditions encountered by an actual seal as it is used in a rock bit. The bearing surfaces between the cone and journal are lubricated with a conventional rock bit lubricant. A drilling mud containing abrasive sand is placed around the cone, including the seal between the cone and journal, so that the seal is in contact with lubricant on an inner surface and drilling mud on an outer surface.

Electrical heaters are used for raising the temperature of water which is circulated around the mud in the test fixture. Pressure difference between the mud on the outside of the seal and the grease on the inside is varied as it would be during service of the rock bit. The cone is rotated at a selected speed and temperature of the journal and cone, torque, and life of the O-ring are measured.

A perfluoroelastomer O-ring of Kalrez type 1050, was tested in such apparatus. The test O-ring had an inside diameter of 5.41 cm. and a cross section of 5.4 mm. The O-ring was mounted in a 6.86 mm. wide annular gland with a 30° V-shape in the cone and a cylindrical surface on the journal. The initial squeeze on the O-ring was 11.46% of the O-ring cross section. The cone was mounted with an eccentricity of 0.25 mm. The bearings were packed with a grease designated as STL-057 by Smith International Inc., Houston, Tex. A conventional pressure compensating reservoir like that in a rock bit was connected to the journal for compensating for volume changes in the grease.

The cone and seal were surrounded with a drilling mud made by mixing 597 grams of bentonite in 12 liters of water to yield a specific gravity of about 1.05 (8.6 pounds per gallon) and with 1259.7 grams of silica flour with a particle size of less than 75 microns added to the bentonite suspension. About 55 grams of soda ash was added to reach a pH of about 9.5. Before the test was commenced, the electrical heaters were set to preheat the test fixture and seal to 93° C. (200° F.), and that setting was maintained throughout the test.

The drilling mud and grease were pressurized to a pressure of 69 bar (1000 psi). During operation of the test apparatus, the pressure on the grease was cycled around that mid-point with a complex cycle including alternating one minute excursions to ±25 psi, ±100 psi and ±150 psi (1.72, 6.9, and 10.3 bar) to simulate pressure cycling which occurs during actual usage of a rock bit. There was a slight asymmetry in the pressure cycling and the average pressure difference across the seal was −5.8 psi (0.4 bar), that is, the grease was at a lower average pressure over the life of the test by 5.8 psi.

The nominal rotational speed for the test was 400 RPM yielding a surface speed of 68 meters per minute at the inside diameter of the O-ring, which is about twice as fast as most testing of O-rings for service in rock bits. The maximum rotational speed was 423 RPM and the average was almost exactly 400 RPM.

The average temperature of the journal was 100° C. (212° F.) and the maximum was 125° C. (257° F.). The average temperature of the cone was 93° C. (200° F.) and the maximum was 113° C. (235° F.). This indicates that the O-ring was primarily rotating with the cone on the journal since the principal temperature rise was on the inside part of the bearing. These are a relatively low temperatures, indicating that the frictional heating by the perfluoroelastomer O-ring was quite low. This is also indicated by an average rotational torque of 232 kg. cm. (202 in. lb.) and a maximum rotational torque of 447 kg. cm. (388 in. lb.).

A maximum of about 5 ml. of mud intruded past the seal during the first 60 hours of the test. Toward the latter part of the test about 5 ml. of grease leaked out past the seal.

Most surprising, the test lasted 96 hours under these conditions without any failure of the O-ring. At the end of this time the O-ring was examined and found to have a wear band 2 mm (0.08 inch) wide on the outside diameter and 1.5 mm (0.06 inch) wide on the inside diameter. The cross sectional dimension of the O-ring decreased 0.23 mm (0.009 inch) in the radial direction and increased 0.4 mm (0.016 inch) in the axial direction. There was a weight loss of 0.21 gram and a volume loss of 0.87 ml.

This can be compared with a similar test with the best known highly saturated nitrile O-ring. The test set-up and procedure was substantially identical except for the following. The nominal and average rotational speed was 380 RPM instead of 400. The average surface speed on the O-ring was therefore about 65 meters per minute. The squeeze on the O-ring was 10.4%.

The average journal temperature was 117° C. (243° F.) with the maximum temperature being 153° C. (308° F.). The average cone temperature was 99° C. (211° F.) and the maximum was 109° C. (228° F.). The increased temperature (17° C. on average in the journal and up to 28° C.) was due to substantial and varying friction between the O-ring seal and the bearing surfaces. This not only subjects the O-ring to higher temperatures, but the problem is compounded since the O-ring is not as capable of withstanding the elevated temperatures as the improved perfluoroelastomer O-ring.

The rotational torque averaged 314 kg. cm. and reached a maximum of 452 kg. cm., an increase of 35%, indicated a substantially greater coefficient of friction.

Furthermore, the seal with the best known nitrile rubber O-ring failed in 79.4 hours. There was no significant leakage during the first 44 hours of the test, however, thereafter mud intrusion occurred at a rate of 0.113 ml/hour until the test was terminated when a preset lime of 10 ml of mud had intruded.

The O-ring had heavy abrasive wear on the inside and a light 2 mm wide wear band on the outside. The inside diameter had increased 0.36 mm. The cross-sectional changes were −0.2 mm radially and +0.6 mm axially. The total seal volume increased 0.3 ml and the weight increased 0.20 grams, probably due to the nitrile elastomer absorbing part of the lubricating grease.

Although limited embodiments of rock bit have been described herein, many modifications and variations will be apparent to those skilled in the art. The exemplary bit described and illustrated is no more than that; there are a variety of bit configurations known in which the high speed O-ring seal may be used. Furthermore, variations may be made in the composition of the perfluoroelastomer. For example, different cure site monomers may be used for introducing crosslinking sites. A variety of additives may be included without departing from the scope of this invention. It is therefore to be understood that, within the scope of the appended claims, this invention may be practiced otherwise than as specifically described.

What is claimed is:

1. A high speed rock bit for drilling subterranean formations comprising:

a bit body including a plurality of journal pins, each having a bearing surface;

a cutter cone mounted on each journal pin and including a bearing surface;

a pressure-compensated grease reservoir in communication with such bearing surfaces;

a grease in the grease reservoir and adjacent the bearing surfaces; and a dynamic O-ring seal for retaining the grease in the bearing, the O-ring seal comprising a perfluorinated terpolymer of tetrafluoroethylene, perfluoro(methyl vinyl ether) and a cure site monomer for introducing crosslinking sites, and carbon black.

2. A high speed rock bit as recited in claim 1 wherein the cure site monomer is selected from the group consisting of trifluoroethylene, vinyl perfluoroalkyls and monomers including a perfluoroalkyl ether group.

3. A high speed rock bit for drilling subterranean formations comprising:

a bit body including a plurality of journal pins, each having a bearing surface;

a cutter cone mounted on each journal pin and including a bearing surface;

a pressure-compensated grease reservoir in communication with such bearing surfaces;

a grease in the grease reservoir and adjacent the bearing surfaces; and a dynamic O-ring seal for retaining the grease in the bearing, the O-ring being formed of a crosslinked terpolymer of tetrafluoroethylene, perfluoro(methyl vinyl ether) and a cure site monomer selected from the group consisting of trifluoroethylene, vinyl perfluoroalkyls and monomers including a perfluoroalkyl ether group.

4. A method for lubricating a rock bit for drilling subterranean formations, the rock bit including a bit body and a plurality of cutter cones mounted on the bit body with rotatable bearings, comprising the steps of:

evacuating a portion of the rock bit body including the bearings;

introducing grease into the evacuated portion of the rock bit body and bearings; and retaining the grease with an O-ring seal comprising a perfluorinated terpolymer of tetrafluoroethylene, perfluoro(methyl vinyl ether) and a cure site monomer for introducing crosslinking sites.

5. A method as recited in claim 4 wherein the cure site monomer is selected from the group consisting of trifluoroethylene, vinyl perfluoroalkyls and monomers including a perfluoroalkyl ether group.

6. A method for lubricating a rock bit for drilling subterranean formations, the rock bit including a bit body and a plurality of cutter cones mounted on the bit body with rotatable bearings, comprising the steps of:

evacuating a portion of the rock bit body including the bearings;

introducing grease into the evacuated portion of the rock bit body and bearings;

retaining the grease with an O-ring seal comprising a perfluorinated terpolymer of tetrafluoroethylene, perfluoro(methyl vinyl ether) and a cure site monomer for introducing crosslinking sites, and carbon black; and rotating the rock bit with a surface speed on the O-ring seal of more than 50 meters per minute.

7. A method as recited in claim 6 wherein the cure site monomer is selected from the group consisting of trifluoroethylene, vinyl perfluoroalkyls and monomers including a perfluoroalkyl ether group.

* * * * *